United States Patent [19]

Mayer

[11] Patent Number: 4,644,998

[45] **Date of Patent: * Feb. 24, 1987**

[54] PRODUCTION OF METAL RODS

[76] Inventor: Frederic C. Mayer, 1407 W. Brooklake Dr., Houston, Tex. 77077

[ * ] Notice: The portion of the term of this patent subsequent to Apr. 16, 2002 has been disclaimed.

[21] Appl. No.: 719,077

[22] Filed: Apr. 2, 1985

Related U.S. Application Data

[63] Continuation of Ser. No. 543,235, Oct. 21, 1983, Pat. No. 4,510,989, which is a continuation of Ser. No. 246,675, Mar. 23, 1981, abandoned.

[51] Int. Cl.[4] ..... B22D 11/00; B22D 11/124

[52] U.S. Cl. ..... 164/461; 164/485; 164/486; 164/475; 164/477

[58] Field of Search ..... 164/444, 485–487, 164/461, 462, 475, 415, 443, 423, 477, 417

[56] References Cited

U.S. PATENT DOCUMENTS

| | | | |
|---|---|---|---|
| 1,426,683 | 8/1922 | Stalhane et al. | 164/461 X |
| 2,363,695 | 11/1944 | Ruppik | 164/485 X |
| 2,864,137 | 12/1958 | Brennan | 164/485 X |
| 3,469,429 | 9/1969 | Dopper et al. | 72/134 |
| 3,512,574 | 5/1970 | Taylor | 164/444 X |
| 3,981,351 | 9/1976 | Dompas | 164/444 |
| 4,082,869 | 4/1978 | Raymond | 164/419 X |
| 4,341,261 | 7/1982 | Thomson et al. | 164/475 |

FOREIGN PATENT DOCUMENTS

| | | | |
|---|---|---|---|
| 77838 | 7/1954 | Denmark | 164/46 |

*Primary Examiner*—Kuang Y. Lin
*Attorney, Agent, or Firm*—Vaden, Eickenroht, Thompson & Boulware

[57] ABSTRACT

There is disclosed a method of continuously casting metal rods wherein the metal is forced to pass through an elongate tube while in a molten state, a cooling medium is circulated about the tube and the metal as it emerges from the tube in order to form a continuous cast rod, and the rod is passed through a bath of another metal whose temperature is sufficiently lower than the melting point of the rod to cool the rod below its critical temperature.

4 Claims, 3 Drawing Figures

PRODUCTION OF METAL RODS

Figure 1:
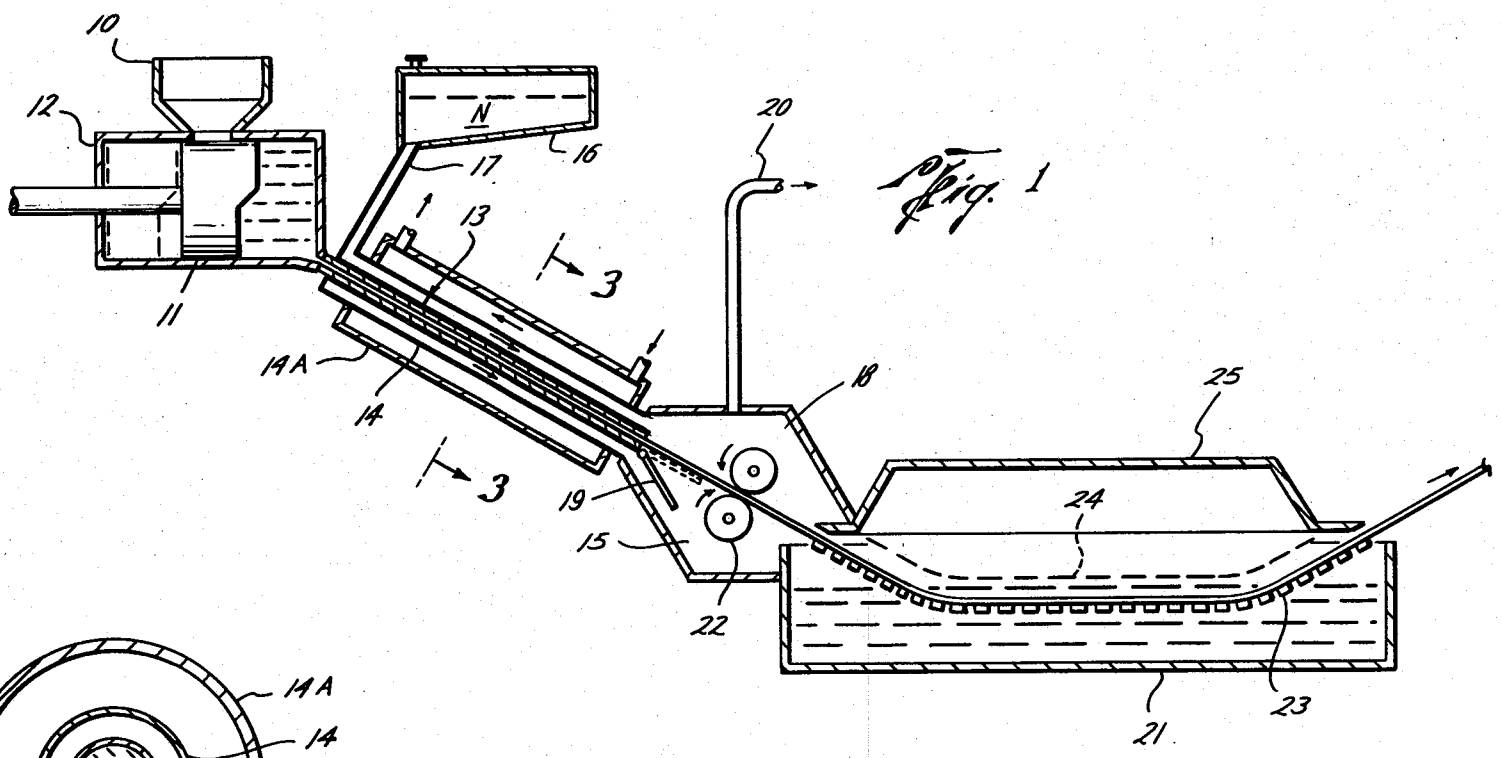

This application is a continuation of my continuation application Ser. No. 543,235, filed Oct. 21, 1983 and entitled "Production of Metal Rods", now U.S. Pat. No. 4,510,989, which in turn was a continuation of the parent application Ser. No. 246,675 filed Mar. 23, 1981, and entitled "Production of Metal Rods", now abandoned.

This invention relates generally to the production of metal rods, and, more particularly, to improvements in the direct production thereof through continuous pressure casting of the metal in a molten state.

In accordance with more conventional techniques for producing such rods, billets of the metal are cast and hot rolled, conditioned and reheated, and, in the case of wire rods, again hot rolled. Prior to being drawn to wire, the rods must be cleaned of mill scale, and, even then, a corrosion resistant coating may be required to protect it against atmospheric conditions.

It has been proposed to reduce the operating and investment costs of these early techniques by a so-called continuous casting process in which molten metal is continuously pressure cast to directly produce the rods, either in intermediate or finished form. In some cases, this process may also eliminate the need for cleaning mill scale from the rod prior to wire drawing.

Although an improvement over the early techniques in these and other respects, the continuous processes of which I'm aware have several drawbacks, particularly in cooling the rod which is extruded from the molten metal, and it is the object of this invention to overcome these drawbacks.

Thus, in accordance with the illustrated embodiment of the present invention, molten metal is continuously pressure cast through an elongate tube, a cooling medium which is oxygen free and inert with respect to the metal is circulated about the tube and the metal as the metal emerges from the tube in order to form a continuous rod of metal, and the rod is passed through a bath of a second molten metal whose temperature is sufficiently lower than the melting point of the rod so as to cool the rod to a temperature below its critical temperature. More particularly, the cooling medium is circulated through a housing which surrounds the tube and the end of the tube from which the cast rod emerges, and the end of the tube connects with an enclosure for the bath and the cooling medium is also inert with respect to the bath metal. Thus, there is no opportunity for mill scale to form on the rods.

In its preferred and illustrated form, the tube is made of a highly heat resistant, low friction material, such as graphite, within a sheath of copper or other highly heat conductive material. The housing is in turn surrounded by a jacket through which cooling water may be circulated in counter flow relation to the cooling medium, both the housing and jacket also being made of a highly heat conductive material such as copper.

In accordance with the preferred and illustrated embodiment of the invention, the molten metal in the bath adheres to the rod as the rod emerges from the bath to form a corrosion resistant coating about the rod, thereby protecting the finished product from corrosive atmospheric conditions. For this purpose, a means is provided for wiping the coated rod as it emerges from the bath in order to remove excess amounts of the second molten metal therefrom.

Preferably, a substantially flat pan is disposed within the bath to receive and guide the rod in a generally horizontal, straight path as it passes therethrough, and perforations are formed in the pan to enable the coolant to circulate therethrough and thus maintain its temperature at a lower level.

A means is also provided for drawing off at least part of the cooling medium from the housing for heat exchange with another medium such as water to be used in further cooling the rod as it emerges from the bath.

In the illustrated embodiment of the invention, the molten metal of which the rod is formed is steel, and the molten bath metal is aluminum. However, the rod may be of a metal other than steel, and the bath metal may be another metal having the characteristics relative to that of the metal rod necessary to permit such rod to be cooled therein to below its critical temperature. The cooling medium, such as liquid nitrogen, may be introduced into the housing at a temperature of about minus 320°, which, upon circulation through the housing, will cool the steel rod to about 1800°–2000° F. to cause it to be at least externally solidified. Upon passage through the aluminum bath, the steel rod will have been cooled to about 1250° F., and thus below its critical temperature.

As the rod emerges from the bath, it is formed into a continuous coil, and the coil is guided onto a screw conveyor which spreads its adjacent convolutions. In this manner, all surfaces of the coil are exposed to the cooling effect of water sprays or the like, which, as previously noted, may be cooled by heat exchange with the cooling medium withdrawn from the housing. From the screw conveyor, the coil may be handled for packaging in any suitable manner.

Although the invention is illustrated, and has particular utility, in connection with the production of metal coil, it will be understood that is also has utility in the production of other products, intermediate or finished, such as wire rods and small bars. In this sense, the term "rod" is not used in the claims to denote a steel rod as that term is used in the technical sense in the steel industry.

Figure 3:
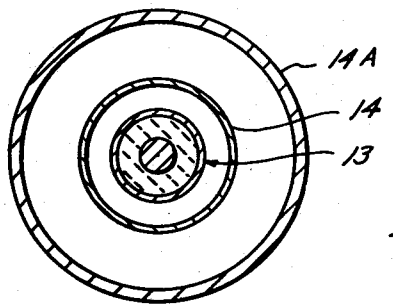
Figure 2:
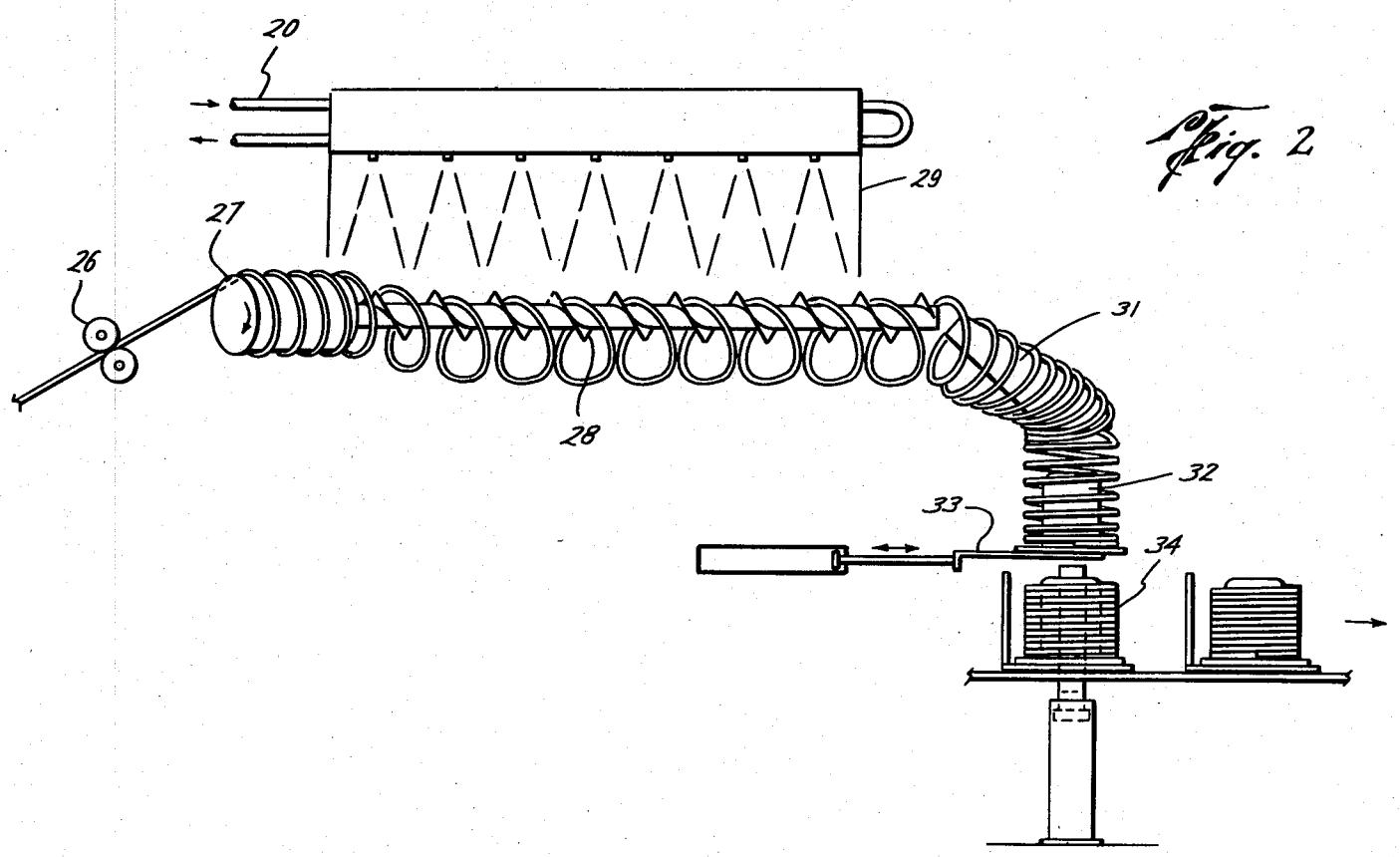

In the drawings, wherein like reference characters are used throughout to designate like parts:

FIG. 1 is a diagrammatic illustration of a portion of the apparatus constructed in accordance with the present invention, including the press from which the molten metal is caused to pass into and through the elongate tube, the housing through which a cooling medium is circulated about the tube to form a rods of such metal, and the bath of a second molten metal through which the rod passes in order to cool it below its critical temperature;

FIG. 2 is a diagrammatic illustration of the remainder of the apparatus including a roll for forming the rod into a coil as it emerges from the bath and the screw conveyor through which the coil convolutions pass as they are cooled by water spray prior to assembling for storage and/or shipment; and FIG. 3 is an enlarged cross-sectional view of the extrusion tube, housing, and water jacket, as indicated in FIG. 1.

With reference now to the above-described drawings, and particularly that portion of the apparatus which is shown in FIG. 1, molten metal is poured from a tundish 10 into a press 11 to the right of a ram 12 when the ram is withdrawn to the left (see broken lines). As the ram moves to the right, it forces the molten metal from the press into and through an elongate tube 13 having its inlet connected to the lower right hand end of the press. As will be explained in the description to follow, the molten metal is cooled as it is forced through the tube 13 so that it emerges from the outlet end thereof as a rod which is at least externally solidified, and thus capable of maintaining its shape during subsequent steps of its production, to be described.

As previously described, the tube 13 is preferably made of graphite encased within a sheath of copper. The graphite is not only highly heat resistant, but also has a low coefficient of friction so that it acts as a lubricant to facilitate continuous pressure casting of a rod having a smooth exterior surface. The copper sheath will, on the other hand, due to its high heat conductivity, accelerate cooling of the molten metal to the desired temperature by means of the cooling medium circulating about the tube.

A housing 14 surrounds the tube and the rod which is extruded therefrom to form an annular space through which the cooling medium may be circulated. Thus, the coolant, which may be liquid nitrogen, is supplied from a suitable source 16 to the end of the housing 14 adjacent the press 11 by means of a duct 17, so that it flows toward the end of the tube from which the rod is continuously pressure cast.

A substantial length of the housing is surrounded by a jacket 14A through which water may be circulated to cool the housing and thus the cooling medium therein. Preferably, water enters the jacket at its end near the emerging rod and leaves through its opposite end near the press, so that it flows counter to the cooling medium in the housing. As previously indicated, both the housing and jacket are also preferably made of copper.

An operator may find that a substantial flow of cooling medium assures sufficient solidification of the rod at the beginning of a cast to enable the flow to be reduced and the major cooling effect to be derived from the water jacket. It will also be understood that the housing intermediate the jacket and extrusion tube isolates the tube from the water in the event of failure of the jacket.

The housing is enlarged, as indicated at 18, to form a chamber 15 therein adjacent the emerging end of the rod, and a flap 19 pivotally connected to the end of the tube 13 so as to support and guide the end of the rod during start up, and then swing downwardly out of the way when the leading end of the rod has been guided into the bath of the molten metal. At least a portion of the cooling medium is withdrawn from the chamber 15 by means of a pipe 20, which preferably, leads to another location at which the cooling medium may be used for additional cooling purposes, as will be described to follow in connection with FIG. 2.

A second molten metal is contained within a suitable receptacle to provide a bath 21 having an inlet connecting with the chamber 15 of housing 14, and an outlet at its opposite end through which the rod emerges upon passage through the molten metal. As shown in FIG. 1, a pair of rollers 22 are arranged within the coolant chamber 15 for feeding the rod into the bath. The rod is guided onto and over a relatively flat pan 23 in the bath as it moves in a straight, generally horizontal path therethrough, and thus with a minimum of deflection. A plate 24 is disposed above the pan to provide an upper limit which prevents extreme buckling of the rod as it is guided over the pan. The pan is preferably provided with perforations which facilitate circulation of the molten bath metal within the receptacle.

A hood 25 is mounted above the bath receptacle to enclose it and form a space above the molten metal which is open to the chamber 15 of the housing to receive the rod at the inlet end of the bath, and which is open at its opposite end to permit the rod to emerge from the bath. Thus, this cooling medium, which is inert to the molten bath metal as well as with respect to the molten metal of which the rod is formed, will circulate through the space from one end to the other in order to cool the bath metal and thus the rod.

As previously described, the molten metal not only cools the rod to a temperature below its critical temperature, but also adheres to the rod to form a sheath thereon as it emerges from the bath, so that, upon hardening, the second molten metal forms a corrosion resistant coating about the rod. The sheath of molten aluminum formed on the rod as it emerges from the bath is passed through a wiper mechanism 26 which removes excess amounts thereof to form the sheath into a coating, upon hardening, of the desired thickness. Thus, this second metal is preferably a material which not only has a melting point relationship with respect to the molten rod metal in order to act as a coolant, but also has the ability to form such a sheath about the rod—i.e., corrosion resistant. In the illustrated embodiment of the invention, wherein the rod is formed of molten steel, the second metal forming the bath is aluminum, although selection of another suitable metal for this purpose will be obvious to person ordinarily skilled in the art.

In the practice of the present invention, the source 16 of liquid nitrogen is maintained at about minus 320° F., and will, when circulated through the housing, lower the temperature of the extruded rod to about 1800°–2000° F., at which temperature the steel is at least externally solidified so as to maintain its shape as it passes through the feed rollers 22 and into the bath of molten metal. Although the major portion of the medium passes from the chamber 15 into the bath, a portion thereof is drawn off through a duct 20 for a purpose to be described to follow.

As previously described, aluminum, or other suitable bath metal, has a melting temperature sufficiently lower than that of steel as to further cool the rod as it passes through the bath. The illustrated embodiment of the invention contemplates that the molten aluminum, when maintained at a temperature of about 1220°–1280° F., will, depending of course of the speed of travel of the rod, cool the rod to about 1250° F. as it emerges from the bath. Means would be provided for maintaining the molten aluminum within this temperature range, this means taking any suitable form such as cooling duct coils in and around the bath receptacle.

As the extruded rod emerges from the bath and into the atmosphere, and then through the wiper mechanism 26, it is received within grooves about a rotary roll 27 to form the rod into a coil having a diameter substantially that of the diameter of the roller. As it leaves the forming roll 27, the rod coil is guided onto a screw conveyor 28 having one end adjacent the end of the forming roll and being disposed generally horizontally beneath a water spray 29 extending longitudinally for its full length. As the coiled rod passes onto the screw conveyor 28 and through its adjacent flutes, its convolutions will be spread apart to provide greater access thereto by means of the water from the spray 29. As previously mentioned, and indicated diagrammatically in FIG. 2, water within the headers of the spray 29 may be cooled by heat exchange relation with the cooling medium supplied through duct 20.

As the coil leaves the screw conveyor 28, it is guided at 31 onto the upper end of a post 32. As the coil moves over the post, its convolutions will be compacted relative to one another by virtue of their weight, and suitable mechanism, such as slide gate 33, may be provided for permitting a desired length of the compacted convolutions to be lowered as a package 34 over another post which extends up into a horizontal conveyor. Upon lowering of the post, as indicated in broken lines, the package may be shifted laterally on the conveyor to a station at which it may be further compacted and strapped for storage and/or shipping.

From the foregoing it will be seen that this invention is one well adapted to attain all of the ends and objects hereinabove set forth, together with other advantages which are obvious and which are inherent to the apparatus and method.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A method for continuously pressure casting steel rods, comprising of the steps of forcing molten steel through an elongate tube to form a continuous rod thereof, causing the rod to pass in a straight, generally horizontal path from which it is deflected in order to move into and out of the upper open end of a receptacle in which molten aluminum is contained and thus through the molten aluminum which adheres to the rod as the rod emerges therefrom to form a corrosion-resistant sheath thereabout, and circulating a cooling medium through a housing which surrounds the tube and the rod as it emerges from the tube, so that the rod is at least externally solidified as it enters the molten aluminum, and from the housing through an enclosure above the receptacle, so that the rod is cooled to a temperature which is below its critical temperature as it emerges from the molten aluminum, said cooling medium being oxygen-free and inert to both steel and aluminum.

2. A method of the character defined in claim 1, wherein the rod is cooled from about 1800°–2000° F. as it enters the bath to about 1250° F., as it emerges from the molten aluminum.

3. A method of the character defined in claim 1, including the further steps of forming the continuous rod into a coil as it emerges from the molten aluminum, guiding the coil onto a screw conveyor which spreads its adjacent convolutions, and spraying a liquid coolant onto the coil as it advances along the conveyor.

4. A method for continuously pressure casting steel rods, comprising of the steps of forcing molten steel through an elongate tube to form a continuous rod thereof, causing the rod to pass in a straight, generally horizontal path into and through a bath of molten aluminum which adheres to the rod as the rod emerges from the bath to form a corrosion-resistant sheath thereabout, circulating a cooling medium through a housing which surrounds the tube and the rod as it emerges from the tube, so that the rod is at least externally solidified as it enters the bath, and from the housing through an enclosure above the bath, so that the rod is cooled to a temperature which is below its critical temperature as it emerges from the bath, said cooling medium being oxygen-free and inert to both steel and aluminum, cooling the rod with another cooling medium when it had emerged from the bath, and drawing off at least part of the first-mentioned cooling medium from the housing and circulating it in heat exchange relation with said other cooling medium.

* * * * *